US005867084A

United States Patent [19]

Hofsäss

[11] Patent Number: 5,867,084

[45] Date of Patent: Feb. 2, 1999

[54] SWITCH HAVING A TEMPERATURE-DEPENDENT SWITCHING MECHANISM

[76] Inventor: Marcel Hofsäss, Bodelschwinghstr. 36, D-75179 Pforzheim, Germany

[21] Appl. No.: 760,859

[22] Filed: Dec. 5, 1996

[30] Foreign Application Priority Data

Dec. 9, 1995 [DE] Germany ..... 195 46 005.7

[51] Int. Cl.[6] ..... H01H 37/04

[52] U.S. Cl. ..... 337/349; 337/327; 337/380; 337/343

[58] Field of Search ..... 337/333, 334, 337/335, 348, 343, 365, 370, 380, 327

[56] References Cited

U.S. PATENT DOCUMENTS 4,317,097 2/1982 Hofsäss .
4,470,033 9/1984 Hofsass ..... 337/343

FOREIGN PATENT DOCUMENTS 0313674 5/1989 European Pat. Off. .
2121802 1/1973 Germany .
3122899 10/1984 Germany .
3710672 10/1988 Germany .
WO 92/20086 11/1992 WIPO .

*Primary Examiner*—Leo P. Picard
*Assistant Examiner*—Jayprakash N. Gandhi
*Attorney, Agent, or Firm*—Harness, Dickey & Pierce, P.L.C.

[57] ABSTRACT

A switch has a temperature-dependent switching mechanism that is received in a housing. The housing has a first housing part on whose inner base a first countercontact is arranged. Also provided is a second housing part, closing off the first housing part, on whose inner base a second countercontact is arranged, such that the switching mechanism creates, as a function of its temperature, an electrically conductive connection between the two countercontacts, to which contact is made from outside through a respective wall of the associated housing part. At least one housing part is made of insulating material. The countercontact in the housing part made of insulating material is arranged in lossproof fashion, for example by casting or injection-molding, in such a way that it is an integral component of said housing part.

19 Claims, 3 Drawing Sheets

SWITCH HAVING A TEMPERATURE-DEPENDENT SWITCHING MECHANISM

BACKGROUND OF THE INVENTION

1. Field of the Invention

The present invention relates to a switch having a housing that has a lower housing part as the first housing part and an upper part, closing off the lower housing part, as the second housing part; and having a temperature-dependent switching mechanism, introduced into the lower housing part, for which a first countercontact is provided on an inner base of the upper part and a second countercontact is provided on an inner base of the lower housing part; such that the switching mechanism creates, as a function of its temperature, an electrically conductive connection between the two countercontacts, to which contact can be made from outside through the associated housing part, and at least one housing part is made of insulating material.

2. Description of Prior Art

A switch of this kind is known from DE 37 10 672.

In the case of the known switch, the housing has a cup-like lower housing part made of electrically conductive material as well as a cover part, closing off the lower housing part, that is made of insulating material. The switching mechanism, which comprises a spring disk that carries a movable contact, is introduced loose into this housing. The spring disk operates against a bimetallic disk that is slipped over the electrical contact. Below the switching temperature the spring disk, which is braced against the base of the lower housing part, presses the movable contact against a countercontact that is provided on the inside of the cover and extends outward, in the manner of a rivet, through the wall of the cover.

Since the spring disk itself is made of electrically conductive material, below the response temperature of the switching mechanism it provides a low-resistance electrically conductive connection between the countercontact on the cover part and the lower housing part, to which contact is made from outside. If the temperature of the switching mechanism is then increased, the bimetallic disk suddenly snaps over and pushes the movable contact, against the force of the spring disk, away from the countercontact on the cover, so that the electrical connection is opened.

Switches of this kind are commonly used for temperature monitoring of electrical devices. As long as the temperature of the electrical device does not exceed a predetermined response temperature, the switch, which for this purpose is connected in series with the load being protected, remains closed. If the temperature of the load then increases excessively, the bimetallic disk snaps over and thus interrupts the flow of current to the load.

It is a disadvantage of the known switch that it is relatively complex to produce. This is due principally to the fact that after production of the cover part, the countercontact must then be fastened onto the cover part; at the same time, an electrically conductive connection out through the wall of the cover part must be provided. This is done in the manner of a rivet that transitions, outside the cover, into a head to which conductors, crimp terminals, etc. must be soldered. This assembly of the countercontact to the cover is generally performed manually, and is thus very cost-intensive.

With the known switch the connection technology is also complex, since after its final assembly is complete, conductors or crimp terminals must be soldered or welded both onto the rivet head and onto the electrically conductive lower housing part at a suitable point. This specific connection technology is, however, very cost-intensive, since it is often implemented by hand.

A further switch, in whose housing a switching mechanism as described above is also arranged, is known from DE 21 21 802 A. In this switch the cover part and lower housing part are both cup-shaped, and are made of electrically conductive material. One-piece crimp terminals are shaped onto the upper part and onto the lower housing part, the crimp terminal of the lower housing part extending outward through a corresponding cutout in the wall of the upper part. An insulating film is arranged between the upper part and the lower housing part in order to insulate the two housing parts electrically from one another.

The switching mechanism thus makes contact on the one hand with the housing lower part via the spring disk, and on the other hand with the cover part via the movable contact, so that an electrically conductive connection exists between the two crimp terminals as long as the temperature of the switching mechanism is below the response threshold. If the temperature of the switching mechanism rises, this electrical connection is opened in the manner described above.

Although the connection technology is very simple to implement with this known switch (conductors simply need to be clamped into the crimp terminals), its assembly is very complex due to the insulating film that must be introduced, and therefore can only be accomplished manually. This manual final assembly is not only wage-intensive, but also leads to assembly errors and thus to a higher reject rate.

A further switch with a lower housing part made of electrically conductive material and a cover part made of insulating material is known from DE 31 22 899 C2. In this switch two connector tongues are cast into the cover part. A first connector tongue is integrally joined to a plate-shaped element that sits in the center of the cover part and carries the first countercontact. The other contact tongue constitutes, together with a contact strip extending transversely, a T-shaped element whose outer ends are bent downward around the cover, where they are in contact (in the assembled state) with the lower housing part, the inner base of which serves as the second countercontact.

Introduced into the metallic lower housing part is a bimetallic switching mechanism which operates in the manner already described above.

With this switch the complex production of the cover part is disadvantageous: after the two connector tongues are cast in, the laterally projecting ends of the contact strip must be bent downward, which requires additional production steps. The known switch is moreover of complex design: during final assembly, it is important that the bent-over ends also in fact come into electrical contact with the lower housing part. A further disadvantage of this switch consists in the fact that further contact resistances are present between the lower housing part and the bent-over ends of the contact strip; these may corrode in everyday use, thus possibly having a negative influence on the function of this switch.

A further switch is known from WO 94/19815. This switch has a housing, made of PTC material, from which two connector tongues project laterally. In this case the temperature-dependent switching mechanism comprises a bimetallic tongue, clamped in at one end, that is joined at its clamped end to a first connector tongue and at its free end carries a movable contact which interacts with a connector element in the interior of the switch that can be configured integrally with the second connector tongue.

This switch is of entirely different construction from the generic switch; in it, for example, completely different demands are made on the bimetallic tongue, since in this case the switching mechanism cannot be introduced loose into the housing as is the case with the generic switch. Assembly of this switch is first of all difficult due to the complexity of introducing the bimetallic tongue in correct position and joining it to the first connector tongue, and also presents further problems associated with the fact that the housing is made of PTC material.

SUMMARY OF THE INVENTION

In view of the above, it is an object of the present invention to improve the switch mentioned at the outset in such a way that with a simple design, it is economical to assemble and allows a simple connection technology.

According to the invention this object is achieved, in the case of the switch mentioned at the outset, by the fact that the lower housing part is made of insulating material and the second countercontact is configured as a flat element that is retained positively, as an integral support element, in the lower housing part.

The object underlying the invention is completely achieved in this manner. Specifically, the lower housing part can now be produced as, for example, an injection-molded plastic part, the countercontact being directly injection-embedded during the injection operation so that it becomes an integral component of the lower housing part. In other words, during the manufacture of this housing part, attachment of the countercontact to that housing part is also accomplished simultaneously, so that multiple operating steps can be omitted. Of course the upper part can also be made of insulating material, the first countercontact then also being retained positively, as an integral support element, in the upper part.

The second and optionally first countercontacts thus perform a double function, so to speak: they act firstly as an electrical contact element and secondly as a support element on which the entire switch, or at least the associated housing part itself, is constructed.

Since at least the lower housing part consists of insulating material, there is also no need for insulating film in order to ensure appropriate electrical insulation between the countercontact and the other housing part. Contact to the countercontact from outside can be made in two fundamentally different ways, which will be explained below.

In a first embodiment, it is preferred if the cast or injection-embedded countercontact has a shaped-on, outwardly projecting connector element that is preferably configured as a clamp terminal, crimp terminal, or solder terminal.

The advantage here is that "assembly" of the countercontact, including making contact through to it from the outside, can be performed integrally and in one operation during production of the relevant housing part. After, for example, casting of the housing part, what is therefore present is a housing part such that the countercontact is arranged on the inner base, and proceeding from it a connector element extends outward through the wall of the housing part and can be configured there as a clamp terminal, crimp terminal, or solder terminal.

In another embodiment, it is preferred if the housing part made of insulating material has a connection channel, passing through one wall, which leads under the countercontact so that an electrically conductive connector element inserted from outside into the connection channel makes electrical contact with the countercontact, retaining means for the connector element preferably being provided in the connection channel.

Here again the relevant housing part is available, after its manufacture, with an integral countercontact, to which contact can now be made with an insertable connector element through the wall, specifically through the connection channel. This connector element can be, for example, a conductor, a plug contact, a connector lug, a connector lug equipped with a conductor, etc. The holding means, which are preferably configured as barbs, hold this inserted connector element in lossproof fashion, so that a further advantage of the new switch consists in the fact that the contact or connection technology is very simple to implement after final assembly. Specifically, to achieve the corresponding connection technology it is necessary only to insert a conductor or a similar connector element into the connection channel of the otherwise completely assembled switch.

The reason is that switches of this kind are often delivered, as semi-finished products without connections, to the corresponding manufacturers of the electrical devices to be protected, where they are then incorporated accordingly into the devices and electrically connected to them. The new switch thus allows a very simple contact system, since the conductors which are in any case present on the device must simply be inserted into the connection channels, where they snap appropriately into place and make contact.

It is further preferred if the switching mechanism comprises a movable contact, carried by a resilient disk that is supported by the second countercontact, that coacts with the first countercontact.

The advantage here is that it is possible to use a bimetallic switching mechanism that is introduced loose, and that aligns itself in the lower housing part, made of insulating material, during final assembly, since both the lower housing part and the resilient disk can be round in configuration. The result is a great advantage in final assembly of the new switch, since no particular attention needs to be paid to the angular alignment between the switching mechanism and lower housing part. The resilient disk can be either itself a bimetallic snap disk or a spring disk that works against the force of a bimetallic snap disk, as is known for example from EP 0 342 441 A2 mentioned above.

The combination of a temperature-dependent switch mechanism of this kind with a lower housing part made of insulating material, in which the countercontact is cast in and can have contact made to it from outside, results in particular advantages in the production and assembly of the new switch. For example, the countercontact can be delivered on a belt, so that then the lower housing part is simply injection-molded on. Then the self-aligning loose switching mechanism is introduced, whereupon the lower housing part is then closed off with the cover part. Since the lower housing part is made of insulating material, no particular actions are necessary for insulation with respect to the cover part, which can be made of metal or itself of insulating material with a cast-in countercontact.

In a preferred embodiment, the countercontact is a metal ring or metal disk, being preferably configured as a punched sheet part in which the connector element is configured integrally with the countercontact.

These features are advantageous in terms of design, since disks and rings, preferably as punched sheet parts, are particularly simple and economical to manufacture and easy to cast in or injection-embed, so that production of the housing part with the integral countercontact arranged in it can be accomplished very economically and easily. Moreover the overall height of countercontacts configured in this manner is very low, so that the miniature design preferred for such switches can be maintained. The countercontacts, for example as disks or rings with connector elements extending from them, can be belt-mounted at those very connector elements so that they are guided in succession through a corresponding plastic shaping machine where the corresponding housing part is, so to speak, configured around the countercontact. The connector element then also extends automatically through a lateral wall of the housing part.

In an embodiment, it is preferred if both housing parts are made of insulating material and each have a countercontact as an integral support element.

The advantage here is that the production of both housing parts can take place in the simple manner described above, so that the entire production of the new switch is very simple and economical. The two housing parts made of insulating material can then be adhesively bonded or welded to one another, for which, for example, UV light, ultrasound, or the like can be used. The connection technology is implemented either by means of two connection channels into which connector pieces are inserted, or by means of two connector pieces extending out through the walls, on which clamping blocks, solder eyes, crimp terminals, etc. can be provided.

In addition it is also preferred if the upper part is made of electrically conductive material, the metal base of that housing part serves as countercontact, and one wall of that housing part is flanged over in such a way that it encloses and holds the lower housing part.

The advantage here is that a simple deep-drawn metal part can be used as the second housing part, on which the second connector of the new switch is provided. The first connector extends, in a manner already described, through the wall of the first housing part made of insulating material. A further advantage of a switch configured in this manner consists in its mechanical stability, which is determined by the other housing part, made of metal, which in that respect encloses the housing part made of insulating material.

Further features and advantages are evident from the description and the appended drawings.

It is understood that the features mentioned above and those yet to be explained below can be used not only in the respective combinations indicated, but also in other combinations or in isolation, without leaving the scope of the present invention.

BRIEF DESCRIPTION OF THE DRAWINGS

Embodiments of the invention are shown in the drawings and will be explained further in the description below. In the drawings.

DESCRIPTION OF PREFERRED EMBODIMENTS

Figure 1:
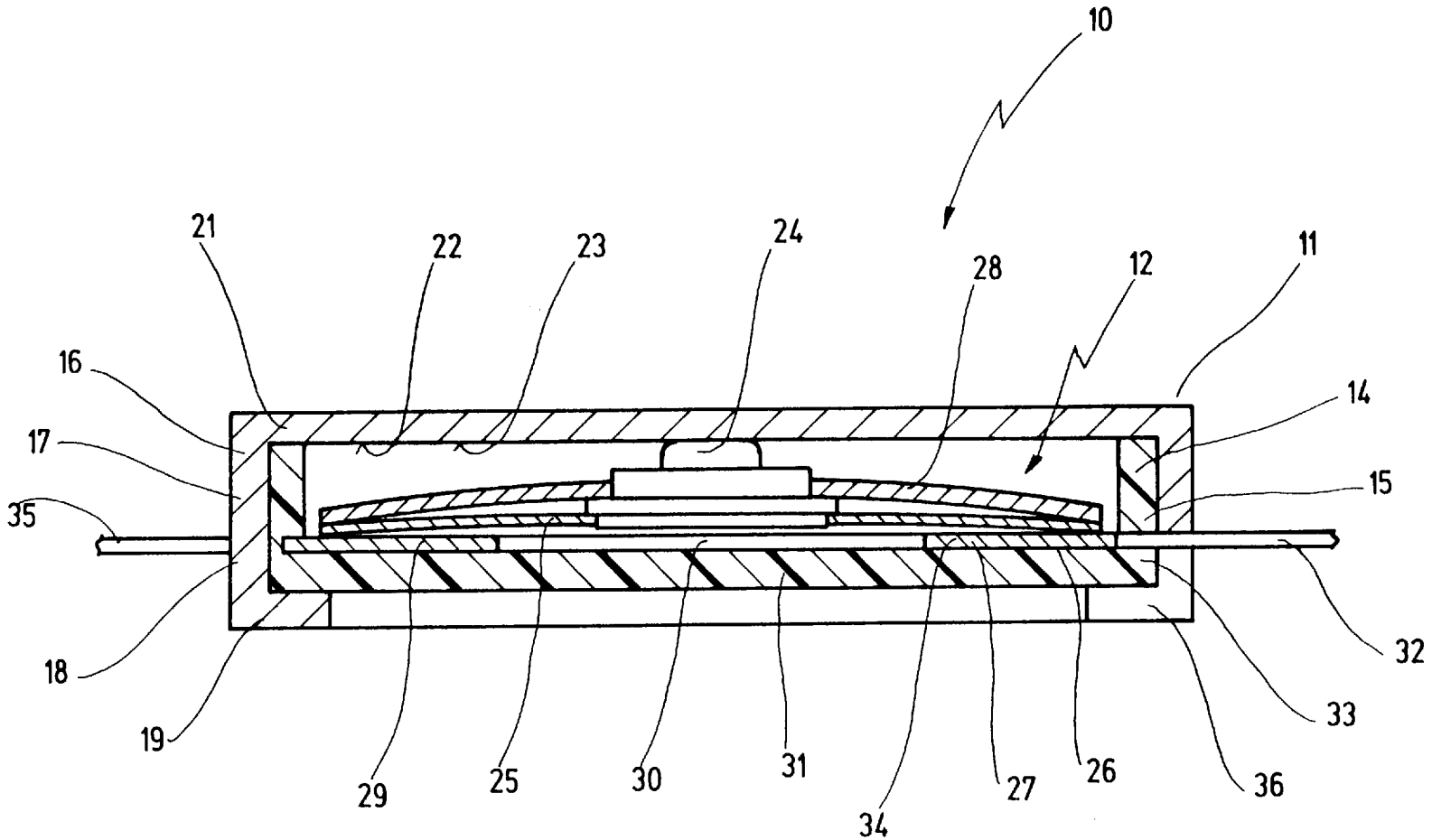
FIG. 1 shows a schematic sectioned illustration, in side view, of the new switch, in which the housing has a lower housing part made of insulating material and an upper part made of metal.

In FIG. 1, 10 designates a switch in whose housing 11 an ordinary temperature-dependent switching mechanism 12 is arranged. Housing 11 comprises a first housing part 14 in the form of a lower housing part 15, as well as a second housing part 16 in the form of an upper part 17, wall 18 of which is flanged over at 19 and thus encloses lower housing part 15.

In the case of switch 10 in FIG. 1, upper part 17 is made of electrically conductive material 21. Upper part 17 acts, with its base 22, as fixed countercontact 23 for a movable contact 24 that is arranged on a spring disk 25 of switching mechanism 12. Spring disk 25 braces against base 26 of lower housing part 15, where a further countercontact 27 in the form of a flat part is arranged. Slipped over movable contact 24 in a known manner is a bimetallic disk 28 that, in the position shown in FIG. 1, is at a temperature below its response threshold. If the temperature of bimetallic disk 28 rises, it snaps over from the convex shape shown into a concave shape, braces itself against base 22 of upper part 17, and thereby pushes movable contact 24, against the force of spring disk 25, away from countercontact 23.

To prevent this from causing a further short circuit, lower countercontact 27 is produced as a ring 29 made of electrically conductive material, and has a center hole 30 through which movable contact 24 comes into contact with base 26 of lower housing part 15, which is made of insulating material 31.

A connector element 32, which extends outward laterally through a wall 33 of lower housing part 15 and is available there to make contact, is configured in one piece with ring 29. Ring 29 and connector element 32 are configured as punched sheet parts 34, which are cast or injection-embedded into insulating material 31 during the production of lower housing part 15 so that countercontact 27 is positively retained as a support element and is thus an integral component of lower housing part 15. Switch 10 is thus, so to speak, constructed on countercontact 27.

A further connector lug 35, which is correspondingly cut out of upper part 17 and bent out upward, is provided on upper part 17 that is made of electrically conductive material 21. Also evident at the right side of FIG. 1 is a cutout 36 in upper part 17, through which connector element 32 extends outward. Both connector element 32 and connector lug 35 can be configured as clamp terminals, crimp terminals, or solder terminals.

With bimetallic disk 28 in the low-temperature position shown in FIG. 1, there exists a low-resistance electrically conductive connection between connector lug 35 and connector element 32 via the electrically conductive upper part 17, movable contact 24, spring disk 25 made of electrically conductive material, and ring 29.

Figure 2:
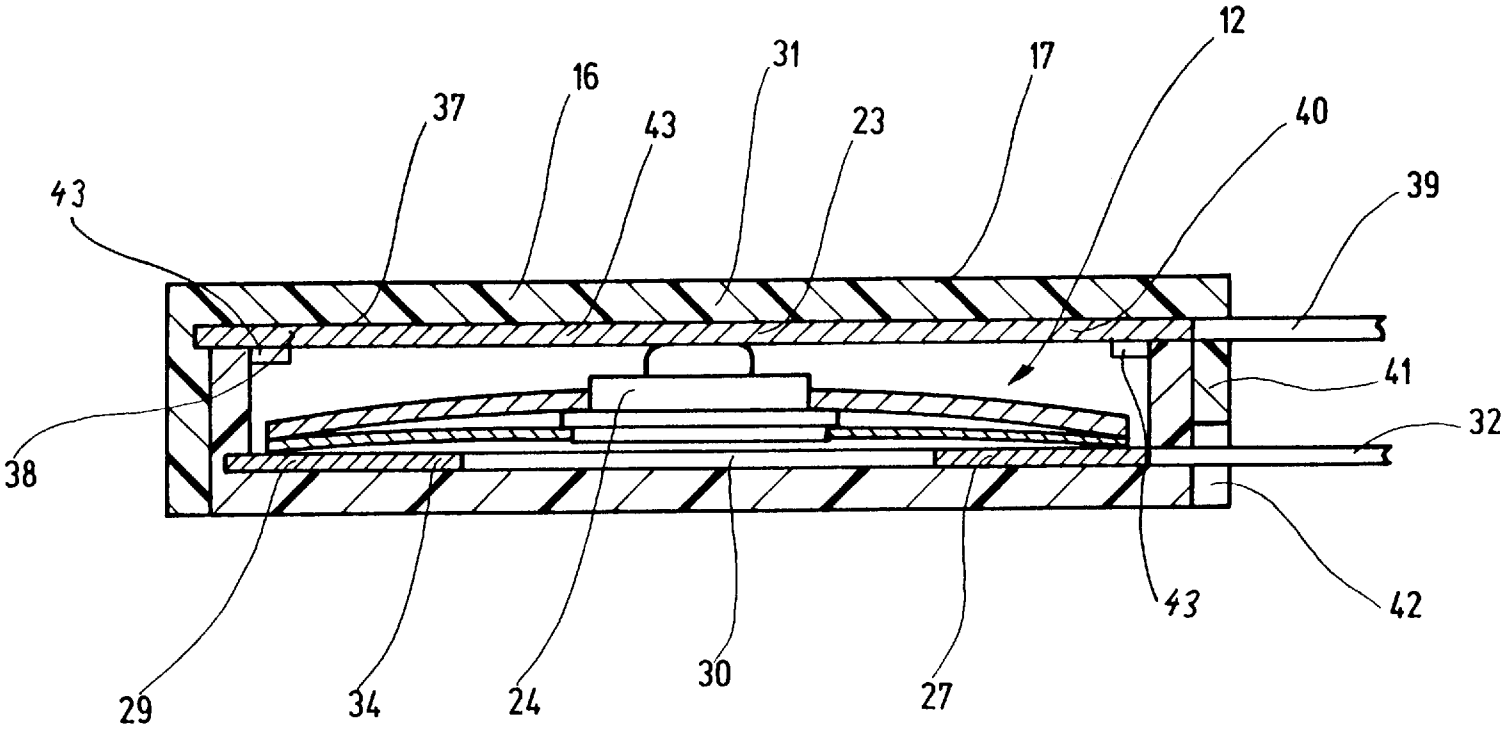
FIG. 2 shows an illustration like FIG. 1, although the upper part is also made of insulating material.

In a further preferred embodiment of the new switch according to FIG. 2, upper part 17 is also made of insulating material 31. Arranged on its base 37 as countercontact 23 is an electrically conductive disk 38 which is joined as one piece to a connector element 39 and was configured as a punched sheet part 40. Connector element 39 extends laterally outward through a wall 41 of upper part 17, where it preferably runs parallel to connector element 32. A cutout 42, through which connector element 32 extends outward, is provided in wall 41.

Punched sheet part 40 is also an integral component of second housing part 17, into which it was cast or injection-embedded during production thereof.

In contrast to countercontact 27, which is configured as ring 29, countercontact 23 is a disk 38, so that in its central region a contact can be created with movable contact 24 when the latter is in contact with disk 38. It is understood that the two countercontacts 23 and 27 can also have other geometrically suitable shapes. It is possible, for example, for the countercontacts to be configured as strips that are cast into the corresponding housing parts.

FIG. 2 further indicates at 43 an abutment which extends radially inward sufficiently far that bimetallic disk 28 comes into contact at its rim with said abutment when it snaps over from the low-temperature position shown into its high-temperature position. This abutment insulates bimetallic snap disk 28 and thus also spring disk 25 with respect to the first countercontact 23, so that with this embodiment as well, the second countercontact 27 can be configured as a disk.

Abutment 43 is not a circumferential shoulder but rather comprises several circumferentially divided "blocks" which allow switching mechanism 12 to be introduced into lower housing part 17 by overcoming the resulting tension on the resilient disks.

Figure 3:
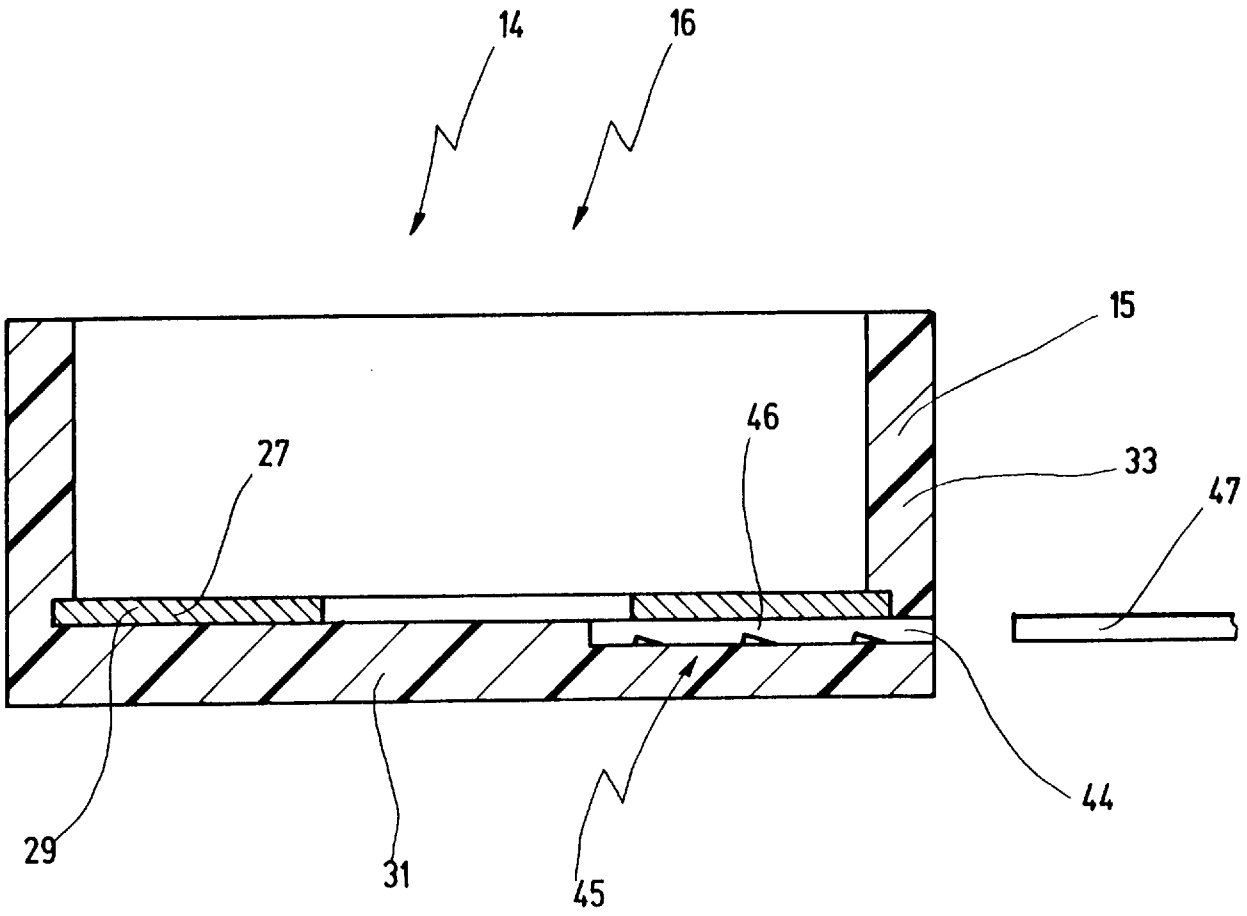
FIG. 3 shows a housing part that can be used for the switches in FIGS. 1 and 2 and is designed for a different connection technology.

FIG. 3 shows a further housing part 14, 16 that can be used with the switches of FIGS. 1 and 2. This housing part 14, 16 is again made of insulating material 31, but has a connection channel 44 that passes laterally through wall 33 below countercontact 27, which in the embodiment shown is a ring 29. Holding means 45 in the form of barbs 46, which hold an inserted connector element 47 in lossproof fashion, are provided in connection channel 44.

A connector element 47 inserted in this fashion ends up below ring 29, where it makes contact with the latter and provides an external electrical connection. Connector element 47 can, for example, be a conductor, a connector lug, a crimp terminal, or a conductor equipped with a crimp terminal, which after complete final assembly of switch 10 needs simply to be inserted from outside in order to effect the connection technology.

Of course it is possible to equip a switch 10 as shown in FIG. 2 with two housing parts, as shown in FIG. 3. After switching mechanism 12 is introduced and the two housing parts 14, 16 are put together, the two housing parts 14, 16 are adhesively bonded or welded to one another in a suitable manner, to which end UV light or ultrasound can, for example, be used.

I claim:

1. A switch, comprising:

a housing that has a lower housing part made of insulating material and a cover part which closes off the lower housing part;

a first countercontact that is provided on an inner base of the cover part;

a second countercontact that is configured as a flat element and is arranged on an inner base of the lower housing part in such a way that it is held positively, as an integral support element, on the lower housing part; and a temperature-dependent switching mechanism that creates, as a function of its temperature, an electrically conductive connection between the first and the second countercontact, wherein contact can be made with the first and second countercontacts from outside through the cover part and lower housing part, respectively.

2. The switch of claim 1, wherein the switching mechanism comprises a movable contact that is carried by a resilient disk that is supported on the second countercontact, that coacts with the first countercontact.

3. The switch of claim 1, wherein the cover part is made of insulating material and the first countercontact is configured as an integral support element and is held positively at the cover part.

4. The switch of claim 2, wherein the cover part is made of insulating material and the first countercontact is configured as an integral support element and is held positively on the cover part.

5. The switch of claim 1, wherein the first countercontact has a shaped-on connector element projecting outward.

6. The switch of claim 3, wherein one countercontact has a shaped-on connector element projecting outward.

7. The switch of claim 4, wherein the first and the second countercontact have a shaped-on connector element projecting outward.

8. The switch of claim 6, wherein the connector element is configured as a clamp terminal, crimp terminal, or solder terminal.

9. The switch of claim 1, wherein the lower housing part made of insulating material has a connection channel, passing through one wall, which leads under the second countercontact so that an electrically conductive connector element inserted from outside into the connection channel makes electrical contact with the second countercontact.

10. The switch of claim 3, wherein the cover part made of insulating material has a connection channel, passing through one wall, which leads under the first countercontact so that an electrically conductive connector element inserted from outside into the connection channel makes electrical contact with the first countercontact.

11. The switch of claim 9, wherein in the connection channel retaining means for the connector element are provided.

12. The switch of claim 10, wherein in the connection channel retaining means for the connector element are provided.

13. The switch of claim 1, wherein the second countercontact is a metal ring.

14. The switch of claim 3, wherein the first countercontact is a metal ring.

15. The switch of claim 1, wherein the second countercontact is a metal disk.

16. The switch of claim 3, wherein the first countercontact is a metal disk.

17. The switch of claim 1, wherein the cover part is made of electrically conductive material, the metal base of which serves as the first countercontact and one wall of which is flanged over so that it encloses and holds the lower housing part.

18. The switch of claim 5, wherein the connector element is configured in one piece with the first countercontact.

19. The switch of claim 6, wherein the connector element is configured in one piece with the associated countercontact.

* * * * *